United States Patent [19]

Kobayashi et al.

[11] Patent Number: 4,631,879

[45] **Date of Patent: * Dec. 30, 1986**

[54] INTERIOR PANEL

[75] Inventors: Hiroshi Kobayashi, Tokyo; Jiro Kano, Kawasaki; Yoshio Kojima; Yoshitoyo Nishite, both of Yokohama; Yutaka Tsuruta, Funabashi, all of Japan

[73] Assignees: Kabushiki Kaisha Toshiba, Kawasaki; Taisei Corporation, Tokyo, both of Japan

[ * ] Notice: The portion of the term of this patent subsequent to Jun. 10, 2003 has been disclaimed.

[21] Appl. No.: 674,088

[22] Filed: Nov. 23, 1984

[30] Foreign Application Priority Data

Nov. 24, 1983 [JP] Japan ..... 58-220987

[51] Int. Cl.[4] ..... E04B 1/00; E04B 5/58; E04F 17/00; E04C 1/00

[52] U.S. Cl. ..... 52/98; 52/126.6; 52/221

[58] Field of Search ..... 52/126.1, 126.2, 126.6, 52/220, 221, 98, 99, 100; 174/65 R

[56] References Cited

U.S. PATENT DOCUMENTS

| | | | |
|---|---|---|---|
| 3,783,176 | 1/1974 | Lund et al. | 174/65 R |
| 4,335,271 | 6/1982 | Haslbeck | 174/65 R |
| 4,389,535 | 6/1983 | Slater et al. | 174/65 R |

FOREIGN PATENT DOCUMENTS

| | | | |
|---|---|---|---|
| 54-129392 | 10/1979 | Japan | 174/65 R |

*Primary Examiner*—William F. Pate, III
*Assistant Examiner*—John Malcolm White
*Attorney, Agent, or Firm*—Oblon, Fisher, Spivak, McClelland, & Maier

[57] ABSTRACT

An interior panel according to the present invention comprises a plurality of support units fixedly arranged on a floor slab, a panel member supported by the support units so as to be located over the slab surface at a predetermined distance therefrom, and a cable separator supported by the support units and dividing the space between the panel member and the slab surface into upper and lower space sections. Cables and electric devices in a signal system are arranged in the upper space section defined by the cable separator, and electric-system cables and devices in the lower space section. A bendable portion is provided at the peripheral edge portion of the cable separator so that an opening to connect the upper and lower space sections is formed by bending part of the bendable portion.

13 Claims, 11 Drawing Figures

INTERIOR PANEL

BACKGROUND OF THE INVENTION

The present invention relates to interior panels adapted to be spread over the floor, foundation, or slab of an office room or computer room to form the room floor and, more specifically, to interior panels permitting an arrangement of power cables, signal transmission cables, and electric devices between the room floor and the slab.

With the progress of microelectronics, office rooms have recently come to be furnished with a number of office-automation apparatuses. Presently, moreover, what is called a local area network is being developed which connects these office-automation apparatuses. The local area network is a system for high-speed data communications of, e.g., 10 Mbit/sec between a plurality of work stations, a large-capacity filing system, and a large-capacity printing system. In order to form such a local area network, therefore, it is necessary to connect the work stations and the large-capacity filing and printing systems by means of signal transmission cables such as coaxial cables or optical fiber cables. Also, the office-automation apparatuses need to be connected with power cables for electric power supply. Accordingly, in an office room provided with the local area network, as in a conventional computer room, the signal transmission cables and power cables are stretched in all directions around the space between the office floor and the floor slab, and couplers, transceivers, modems and other electric devices connecting the signal transmission cables and the individual office-automation apparatuses, along with electric devices connected to the power cables, are arranged in accordance with the layout of the apparatuses.

In laying the signal transmission cables and power cables in an office room, they are legally required to avoid contact with one another. It is, therefore, very difficult to properly arrange the signal transmission cables and power cables in offices with the local area network.

In the offices, moreover, there may frequently arise the need for changing the layout of office-automation apparatuses or installing addition office-automation apparatuses. In this case, rearrangement of the signal transmission cables and power cables would conventionally require large-scale construction job, rendering the layout of the office-automation apparatuses less readily adaptable.

SUMMARY OF THE INVENTION

The object of the present invention is to provide an interior panel permitting a safe and easy arrangement of signal transmission cables, power cables, and various electric devices in an office or computer room and which is capable of readily coping with a layout change of the apparatuses installed in the room.

An interior panel according to the present invention overlies the surface of a slab such as a floor, wall or ceiling slab defining the inside space of a room to form the interior surface of the room so that a space permitting the installation of signal transmission cables, power cables, and electric devices can be secured between the interior panel and the slab surface.

This interior panel comprises a plurality of support members set up on the slab surface, a panel member supported by the support members and suitably separated from the slab surface, a cable separator interposed between the panel member and the slab surface, the cable separator having the form of a plate with a stepped portion at the peripheral edge portion thereof supported on the support members so that the stepped portion faces upward, whereby the space between the panel member and the slab surface is divided into a first space defined between the panel member and the cable separator for the arrangement of the signal transmission cables and a second space defined between the cable separator and the slab surface for the arrangement of the power cables, and bending means provide to at least one part of the stepped portion of the cable separator, whereby the stepped portion is partially bent to form an opening for connecting the first and second spaces.

According to the present invention, the signal transmission cables in the first space and the power cables in the second spaces are separated by the cable separator, so that they can securely be prevented from coming into contact with one another. In arranging these cables, the power cables are first laid on the slab surface, and then the second space for the arrangement of the power cables is defined by means of the cable separator. Thereafter, the signal transmission cables are laid on the cable separator. Thus, the signal transmission cables can be laid irrespectively of the arrangement of the power cables, that is, the arrangement of the cables is easy.

According to the present invention, moreover, the cable separator has the form of a plate with the stepped portion at its peripheral edge portion, and is set so that the stepped portion faces upward. Thus, the first space between the panel member and the central recessed portion of the cable separator can be kept wide. Therefore, a modem, transceiver, coupler or other electric device connected to the signal transmission cables may readily be contained in the space between the panel member and the recessed portion of the cable separator. Also, a brancher or the like connected to the power cables may be set in the wide second space between the slab surface and the stepped portion of the cable separator.

According to the present invention, furthermore, the cable separator is provided at its stepped portion with the bendable portion, whereby the stepped portion can be partially bent to form an opening for connecting the first and second spaces. Thus, the power cables in the second space can easily be led into the first space through the opening, and also onto the panel member through the first space and the panel member.

According to an aspect of the present invention, the power cables led out into the first space through the opening can assuredly be prevented from coming into contact with the signal transmission cables in the first space, taking advantage of bendable strips bent by means of the bendable portion or the edge of an opening formed by bending the bendable strips.

DETAILED DESCRIPTION OF THE PREFERRED EMBODIMENTS

Figure 1:
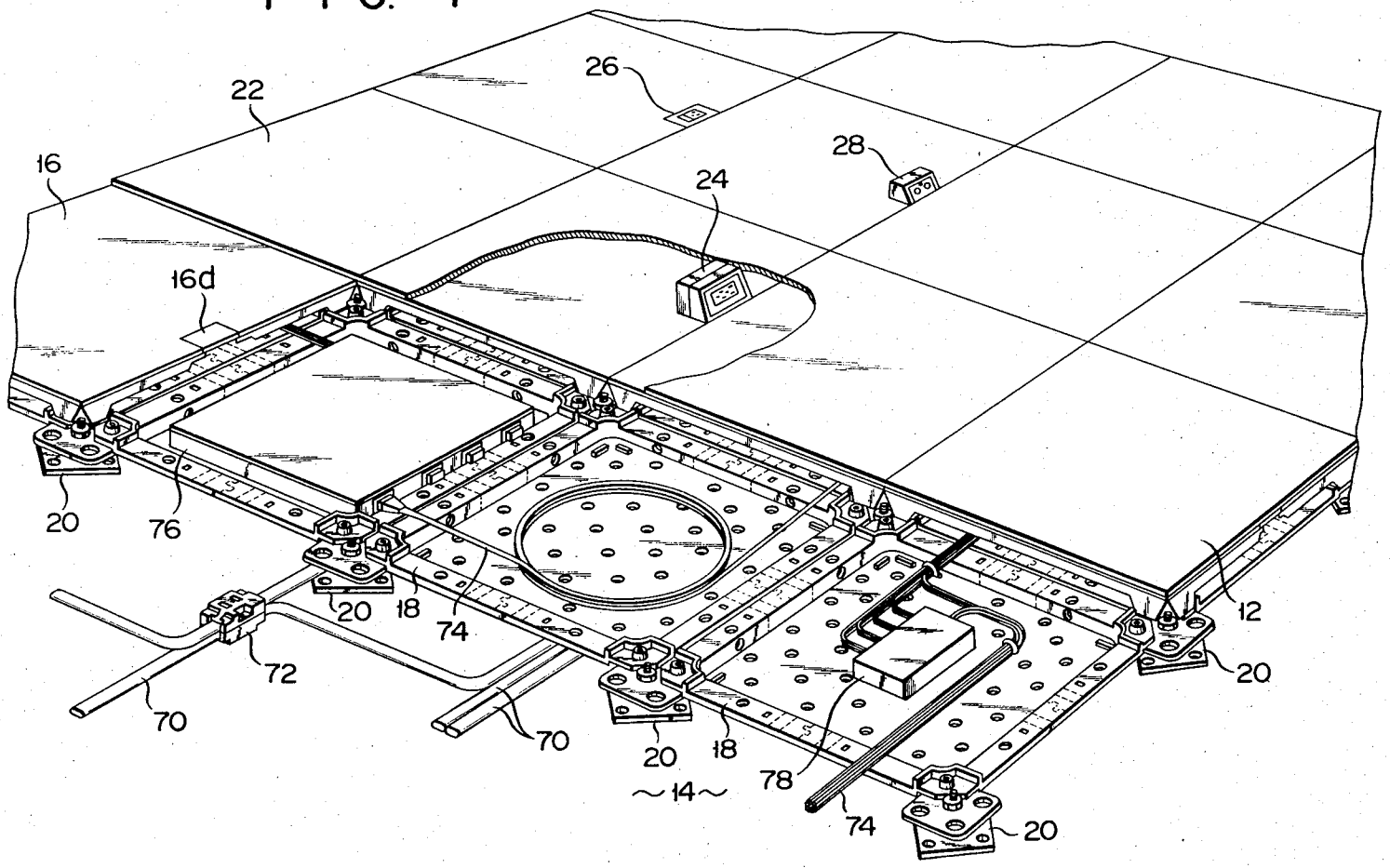
FIG. 1 is a perspective view showing the way a plurality of floor panels according to a first embodiment of the present invention, furnished with signal transmission cables and power cables, are spread over a floor slab.

Referring now to FIG. 1, there are shown floor panels 12 as a specific example of interior panels according to a first embodiment of the present invention. The floor panels 12 are spread over a floor slab 14 of an office, forming the office floor.

Figure 2:
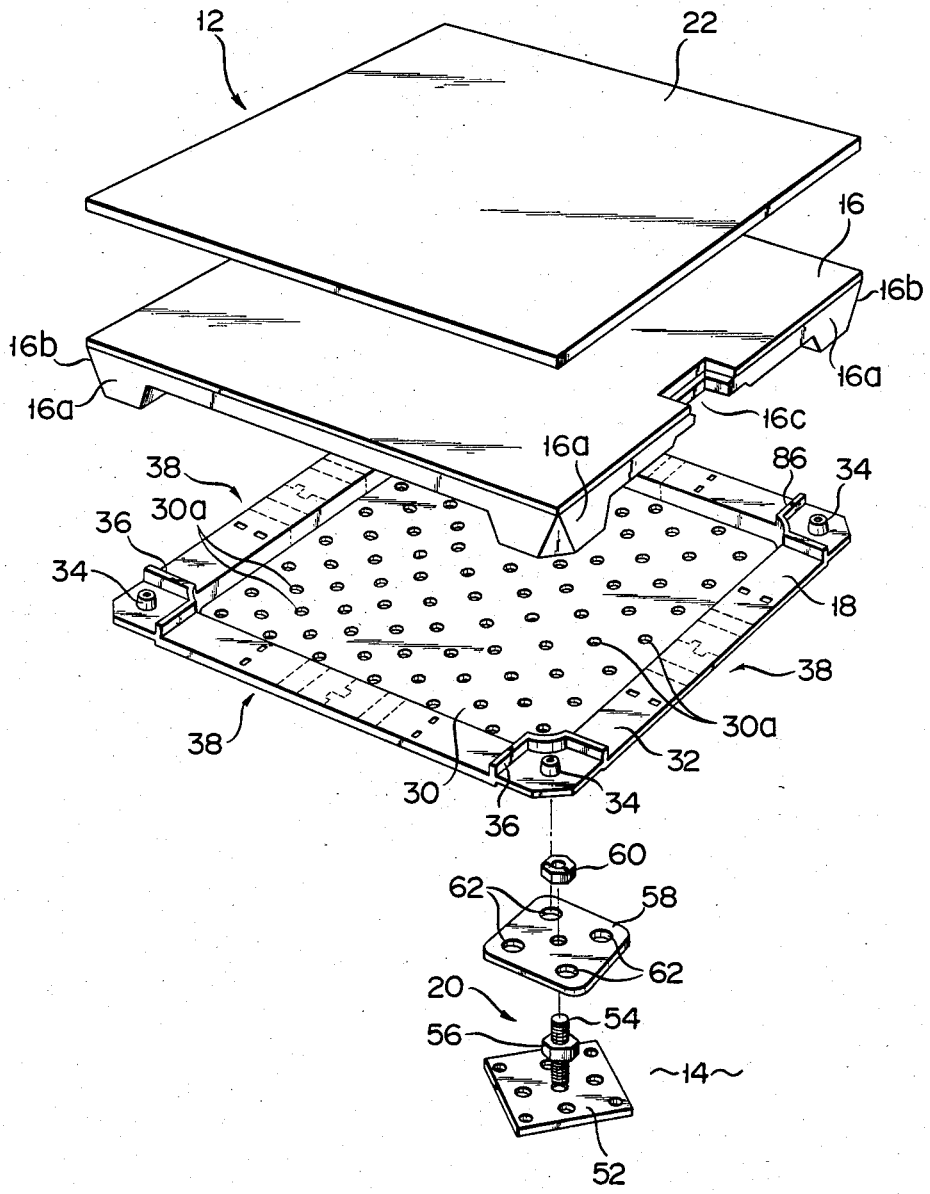
FIG. 2 is an exploded perspective view of one of the floor panels shown in FIG. 1.

As shown in detail in FIG. 2, each floor panel 12 includes as its main components a panel member 16, a cable separator 18, and a plurality of support units 20. The panel member 16 is formed in the shape of a square of, e.g., 50 cm×50 cm for the ease of construction work and transport. The panel member 16 is made of, e.g., glass-reinforced cement. Four leg portions 16*a* protrude downward from the four corners of the lower surface of the panel number 16, individually. A bevel 16*b* is formed on each leg portion 16*a* of the panel member 16 so that the respective bevels 16*b* of each two diagonally adjoining panel members 16 face each other in the state of FIG. 1 in which the floor panels 12 are spread over the floor slab 14. A blind hole (not shown) is formed in the bottom surface of each leg portion 16*a* of the panel member 16.

A rectangular indentation 16*c* is formed in one side of the panel member 16. The indentation 16*c* is utilized for leading out signal transmission cables or power cables (mentioned in detail later) onto the floor. An outlet box 24, a floor outlet 26, or a cable fitting 28 can be fitted in the indentation 16*c*. Thus, these connection device are connected to a signal transmission cable or a power cable. If unnecessary, the indentation 16*c* can be filled up with a blank piece 16*d*, as shown in FIG. 1. The blank piece 16*d* is formed of the same material as the panel member 16.

In the case of the first embodiment, the floor panel 12 is provided with a surface member 22 pasted on the surface of the panel member 16. The surface member 22, which has the same square shape and the same size as the panel member 16, is formed from a conventional flooring material such as vinyl tiles or carpeting, depending on the application of the office room. If the outlet box 24, the floor outlet 26, or the cable fitting 28 is fitted in the indentation 16*c* of the panel member 16, that portion of the surface member 22 corresponding to the indentation 16*c* is to be cut off.

The cable separator 18 is formed from an electric insulating material, such as polypropylene, polyvinyl chloride or asbestos. In this case, polypropylene is adapted for the use because of its transparency and good strength. The cable separator 18 is formed of a substantially square plate similar to the panel member 16, and has a square depression 30 in the center. Thus, the peripheral edge portion of the cable separator 18 constitutes a stepped portion 32 which projects upward from the depression 30. Substantially conical upper and lower projections 34 protrude upward and downward from the four corner portions of the stepped portion 32 of the cable separator 18, individually. The upper projections 34 of the stepped portion 32 are adapted to be fitted in the blind holes in the bottom surface of the leg portions 16*a* of the panel member 16 when the cable separator 18 and the panel member 16 are joined together. Partition walls 36 are formed individually on the four corner portions of the upper surface of the stepped portion 32 so as to surround their corresponding projections 34 from two directions.

Figure 3:
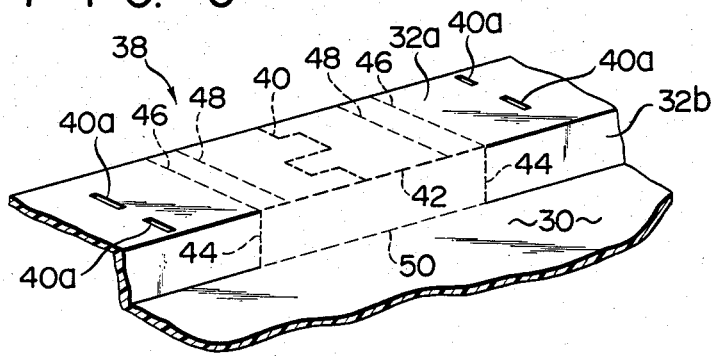
FIG. 3 is an enlarged perspective view showing part of a stepped portion of a cable separator.
Figure 7:
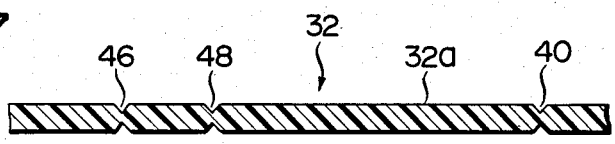
FIG. 7 is a sectional view of the bendable portion at the stepped portion of the cable separator.

Bendable portions 38 are formed individually at the respective central portions of the four sides of the stepped portion 32 of the cable separator 18. As shown in FIG. 3, for example, each bend portion 38 has a zigzag cut line 40 extending across its level surface portion 32*a* parallel to the depression 30, a cut line 42 extending along the depression-side edge of the level surface portion 32*a* so as to cross the cut line 40 at the center, and a pair of cut lines 44 vertically formed on a vertical surface portion 32*b* of the bendable portion 38 perpendicular to the depression 30 and connecting with their corresponding ends of the cut line 42. The cut lines 40, 42 and 44 are indicated by thick broken lines in FIG. 3. The bendable portion 38 is further provided with a pair of bend lines 46 extending across the level surface portion 32*a* so as to connect with their corresponding cut lines 44, a pair of bend lines 48 extending inside and parallel to the bend lines 46 on the level surface portion 32*a*, and a bend line 50 extending parallel to the cut line 42 on the vertical surface portion 32*b* so as to connect the depression-side ends of the cut lines 44. The bend lines 46, 48 and 50 are indicated by fine broken lines in FIG. 3. The cut lines and bend lines can be formed by cutting V-shaped grooves in the stepped portion 32 of the cable separator 18, as shown in FIG. 7. The cut lines may alternatively be formed of perforated lines to be distinguished from the bend lines. It is necessary only that the cut lines of the stepped portion 32 be able to facilitate the cutting at the stepped portion 32 with use of a knife, nipper or other tool. A pair of insertion slits 40*a* are formed in the level surface portion 32*a* of the bendable portion 38 on the opposite side of each corresponding bend line 46 to its corresponding line 48. One of the insertion slits 40*a* is adapted to fix a bendable piece of the level surface portion 32*a* by receiving a protrusion of the bendable piece which is defined by the cut line 40 when the bendable portion 38 is cut along the cut lines 40 and 42 and the bendable piece is bent along the bend lines 46 and 48.

A number of holes 30*a* are bored in the form of a matrix through the depression 30 of the cable separator 18. The holes 30*a* are used in rigidly mounting the signal transmission cables or electric devices connected thereto on the depression 30.

The support unit 20 will now be described in detail. The support unit 20 is provided with a pedestal 52 which is formed of a metal plate. A bolt 54 protrudes from the central portion of the pedestal 52. A first nut 56, a metallic flange plate 58, and a second nut 60 can be successively screwed on the bolt 54 of the pedestal 52. A tapped hole mating with the bolt 54 is bored through the central portion of the flange plate 58. The flange plate 58 is square, and four holes 62 capable of receiving the projections 34 of the cable separator 18 are bored individually through the four corner portions of the flange plate 58.

The floor panels 12 with the above-mentioned construction are spread over the floor slab 14 of the office room in the following manner. First, the support units 20 are arranged at regular intervals to form a matrix on the floor slab 14, as shown in FIG. 1. In doing this, the support units 20 are fixed so that their pedestals 20 are in contact with the floor slab 14. At this time, the respective flange plates 58 of the support units 20 are leveled for evenness by adjusting the positions of the nuts 56 and 60.

Thereafter, power cables 70 for supplying electric power to office-automation apparatuses to be installed in the office are arranged on the floor slab 14 in accordance with the layout of the apparatuses. In laying the power cables 70, branchers or other electric devices 72 in a power supplying system connected to the power cables 70 are arranged mainly on those lines which connect the support units 20, as shown in FIG. 1.

After the arrangement of the power cables 70 is finished, the cable separators 18 are each put in a division defined by each four adjacent support units 20 so that the stepped portions 32 of the cable separators 18 face upward, as shown in FIG. 1. Thus, the cable separators 18 are spread over the floor slab 14, leaving a suitable space between them. In doing this, the lower projections 34 at the four corners of each cable separator 18 are each fitted in one of the four holes 62 in the four corner portions of the flange plate 58 of each of their corresponding four support units 20. Thus, the cable separators 18 are supported by four support units 20 each. As seen from FIG. 1, the remaining three holes 62 of the flange plate 58 of each support unit 20 are used for receiving the lower projections 34 of the adjoining cable separators 18.

Each of the electric devices 72 in the power supplying system is located under the adjoining sides of the respective stepped portions 32 of two adjacent cable separators 18. Accordingly, the appropriate distance between the floor slab 14 and the cable separators 18 in the region for the electric device 72 is maintained by the pair of stepped portions 32. Thus, the cable separators 18 constitute no hindrance to the arrangement of the electric devices 72 in the power supplying system.

After the cable separators 18 are arranged in this manner, they are fitted with signal transmission cables 74, including coaxial cables, optical fiber cables, and telephone lines, which are connected to the office-automation apparatuses to be installed in the office in accordance with the layout of the apparatuses. While the signal transmission cables 74 are being laid, the cable separators 18 are fixedly mounted with couplers, transceivers, modems or other electric devices 76 in a signal transmission system or telephone terminal 78. As shown in FIG. 1, spare signal transmission cables 74 are also kept in the depressions 30 of some of the cable separators 18. The electric devices 76, the telephone terminals 78, and the spare signal transmission cables 74 are fixed by the use of fixing means (not shown) which are attached to the holes 30*a* in the depressions 30 of the cable separators 18.

Figure 4:
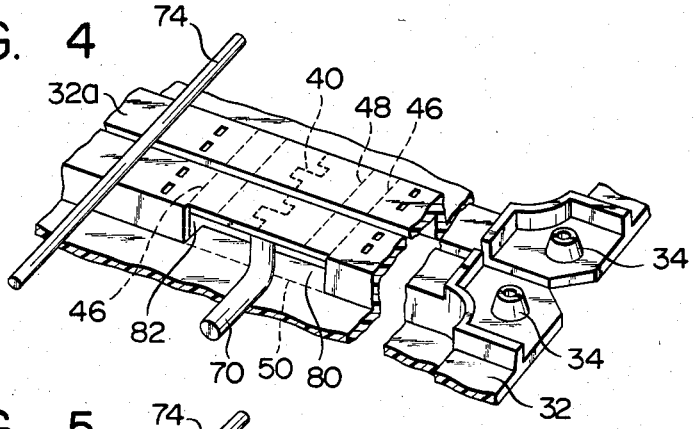
FIGS. 4 to 6 are partial perspective views showing different manners in which a cable is led out through a bendable portion formed at the stepped portion of the cable separator.
Figure 5:
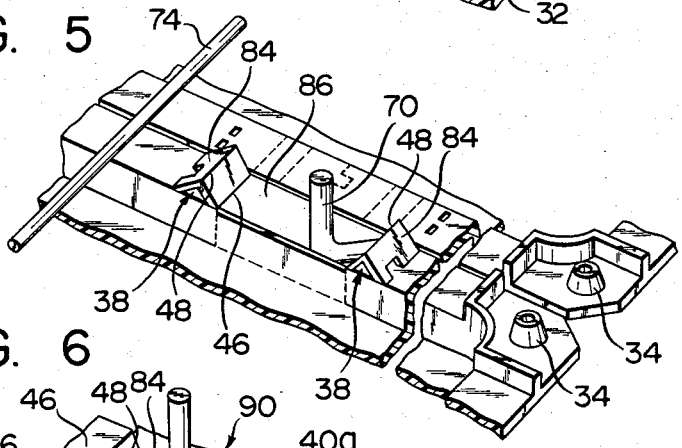

Referring now to FIGS. 4 and 5, a method will be explained of taking out the power cables 70 over the floor slab 14 onto the cable separator 18. FIG. 4 shows an example in which one of the power cables 70 to be connected to the signal-system device 76 on one of the cable separators 18 is taken out from under the cable separator 18 onto the same. In this case, one of the bendable portions 38 of the stepped portion 32 of the cable separator 18 is cut along the cut lines 42 and 44, and a bendable strip 80 is bent straight to the outside along the bend line 50. Thus, an opening 82 is formed in the stepped portion 32 of the cable separator 18 through which the power cable 70 underlying the cable separator 18 can be led out onto the same and connected to the electric device 76. In this case, even if one of the signal transmission cables 74 is disposed near the opening 82, the power cable 70 can assuredly be prevented from touching the signal transmission cable 74 since its movement is restrained by the edge of the opening 82.

Referring now to FIG. 5, there is shown an example of the way the power cable 70 to be connected to the office-automation apparatuses in the office room is taken out from under the cable separator 18. In this case, the bendable portion 38 of the stepped portion 32 of the cable separator 18 is cut along the cut lines 40 and 42, and a pair of bendable strips 84 are triangularly turned up along the bend lines 46 and 48. Each of the protrusions of the bendable strips 84 defined by the cut line 40 is inserted in one of its corresponding insertion slits 40*a*, thereby fixing the bendable strips 84 to the level surface portion 32*a* of the stepped portion 32. Wheh the pair of bendable strips 84 are bent in this manner, an opening 86 is formed in the level surface portion 32*a* of the stepped portion 32 of the cable separator 18. The power cable 70 can be taken out onto the cable separator 18 through the opening 86. In this case, even if the signal transmission cable 74 is disposed near the opening 84, it can assuredly be prevented from touching the power cable 70 since it is restrained from moving toward the power cable 70 by wall portions 88 defined by the triangularly bendable strips 84.

Figure 6:
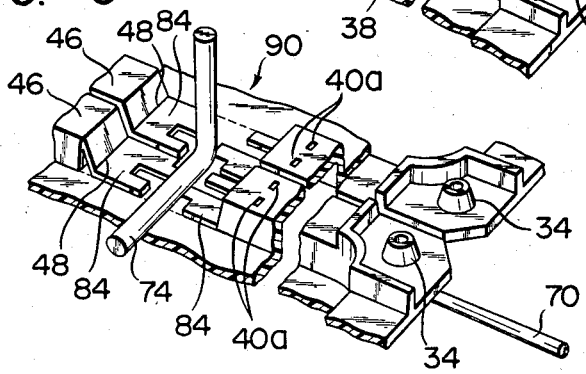

Referring further FIG. 6, there is shown an example of the way the signal transmission cable 74 connected to the electric device 76 set in the depression 30 of the cable separator 18 is upwardly taken out. In this case, each of the adjoining bendable portions 38 of the respective stepped portions 32 of two adjacent cable separators 18 is cut along its cut lines 40, 42 and 44. The respective bendable strips 80 of the two bendable portions 38 are bent straight to the outside, as in the case shown in FIG. 4, and the bendable portions 84 are bent downward. As a result, a depression 90 is formed in a part of the two adjoining stepped portions 32. Thus, even if there is not an enough space to allow the signal transmission cable 74 to be bent and led upward between the electric device 76 in the depression 30 of one of the two adjacent cable separators 18 and the stepped portion 32 of the cable separator 18, the signal transmission cable 74 can be guided upward through the depression 90 at the stepped portions 32. In this case, even though the power cable 70 underlies these stepped portions 32, it can assuredly be prevented from coming into contact with the signal transmission cable 74 by the bendable strips 80 which underlie the depression 90.

After the power cables 70 and the signal transmission cables 74 to be led onto the office floor are arranged in this manner, the panel members 16 are put individually on the cable separators 18 to form the office floor. At the same time, the upper projections 34 at the four corners of each cable separator 18 are fitted individually in the blind holes in the bottom surfaces of the four corner leg portions 16*a* of each corresponding panel member 16. Thus, the panel members 16 are supported on the support units 20 through the medium of the cable separators 18.

The power cables 70 to be led onto the office floor may be connected to the outlet boxes 24 or the floor outlets 26 fitted in the indentations 16*c* of their corresponding panel members 16, or may be taken out onto the floor through the cable fittings 28 also fitted in the indentations 16*c* of their corresponding panel members 16. Likewise, the signal transmission cables 74 are led onto the office floor through the cable fittings 28 in the indentations 16*c* of their corresponding panel members 16.

Thereafter, the surface members 22 such as carpeting are pasted on the spread panel members 16 to complete the office floor.

After this is done, moreover, the office-automation apparatuses are set on the office room floor in accordance with their predetermined layout, and the power cables 70 and the signal transmission cables 74 are connected to these apparatuses.

According to the floor panels 12 of this embodiment, as described above, the signal transmission cables 74 are arranged in a first space defined between the panel members 16 and the cable separators 18, and the power cables 70 in a second space between the cable separators 18 and the floor slab 14. Accordingly, the power cables 70 and the signal transmission cables 74 can assuredly be isolated from one another by the cable separators 18. Thus, in laying the power cables 70 or the signal transmission cables 74, they can be arranged irrespectively of the arrangement of their matches, facilitating the construction work.

In taking out the power cables 70 arranged in the second space onto the office room floor through the first space, there is a possibility of the power cables touching the signal transmission cables 74 in the first space. In this case, however, unexpected contact between the power cables 70 and the signal transmission cables 74 can assuredly be prevented by taking out the power cables 70 through the second space in the manner shown in FIGS. 4 and 5.

Since each cable separator 18 has the depression 30 and the stepped portion 32, the signal-system device 76 or the like may fully be housed in the depression 30, and the brancher or other power supplying system device 72 may be interposed between the floor slab 14 and the stepped portion 32. Thus, according to the floor panel 12 of the present invention, the space between the panel member 16 and the floor slab 14, including the aforesaid first and second spaces, can effectively be utilized for the arrangement of the electric devices in the power supply and signal transmission systems. This leads to a reduction of the overall thickness of the floor panel 12.

In the case of the floor panel 12 of the present invention, moreover, the panel member 16 and the cable separator 18 are removably mounted on the support units 20. If any of the office-automation apparatuses previously installed in the office requires a change of layout, therefore, the panel member 16 and/or the cable separator 18 may be removed for rearrangement of the signal transmission cables 74 and/or the power cables 70. Since the cable separators 18 are formed of transparent polypropylene, moreover, the power cables 70 can be visually checked for arrangement with ease through the cable separators 18. Also from this point of view, the floor panel 12 of the invention is adapted for use as a free-access floor panel which can readily cope with a layout change of office-automation apparatuses.

Figure 8:
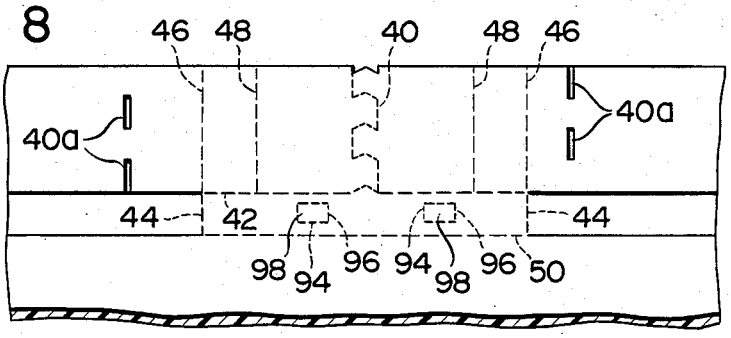
FIG. 8 is a perspective view of the bendable portion at the stepped portion of a cable separator according to a second embodiment of the invention.
Figure 9:
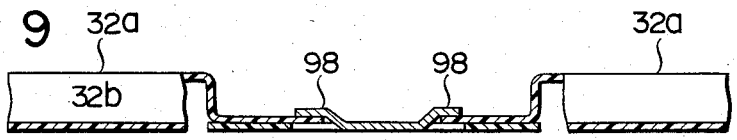
FIG. 9 is a partial sectional view showing a state in which the bendable portion shown in FIG. 8 is bent in the same manner as in FIG. 6.

The present invention is not limited to the floor panel 12 of the first embodiment described above. Referring now to FIGS. 8 and 9, there is shown a stepped portion 32 of a cable separator 18 according to a second embodiment of the present invention. The stepped portion 32 is provided with a bend portion 38 similar to the one used in the first embodiment. In the description to follow, like reference numerals are used to designate like portions as in the first embodiment, and only the differences between the first and second embodiments will be explained. First, a bend line 92 is cut in the protruding, bendable strips 84 defined by the cut line 40 and bend lines 46 and 48 so that the end portions of the protrusions can be bent along the bend line 92. With use of the bend line 92 of the bendable strips 84, the ends of each bendable strip 84 can easily be inserted into one its corresponding insertion slits 40*a* when the bendable strips 84 are bent as shown in FIG. 5.

A pair of raisable lug portions 98, each defined by cut lines 94 and a bend line 96, are formed in that region of the stepped portion 32 which is defined by cut lines 42 and 44 and a bend line 50. When the bend portion 38 is bent in the manner shown in FIG. 6, the raisable lug portions 98 of a bendable piece 80 of the bendable portion 38 can be raised to hold down the bendable strips 84, as shown in FIG. 9. Thus, the bendable strips 84 can securely be kept in a bent state.

Figure 10:
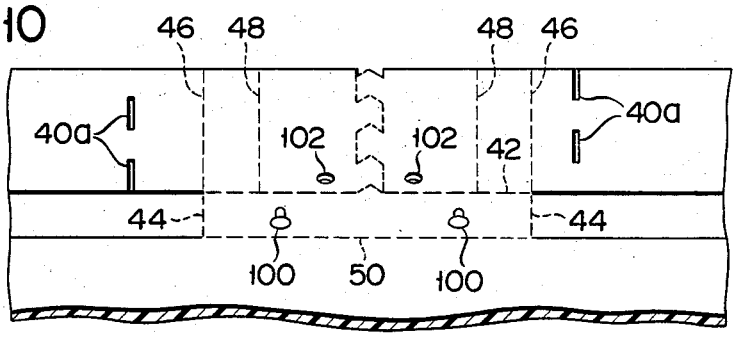
FIG. 10 is a perspective view of the bendable portion at the stepped portion of a cable separator according to a third embodiment of the invention.
Figure 11:
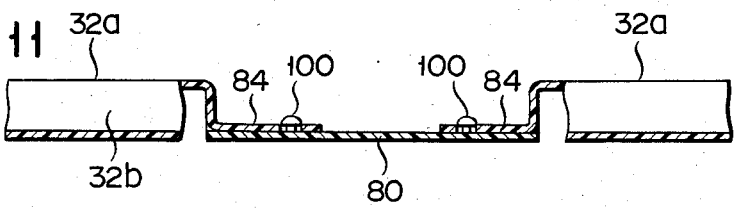
FIG. 11 is a partial sectional view showing a state in which the bendable portion shown in FIG. 10 is bent in the same manner as in FIG. 6.

Referring now to FIG. 10, there is shown a stepped portion 32 of a cable separator 18 according to a third embodiment of the present invention. The stepped portion 32 is integrally formed with a pair of projections 100 in place of the raisable lug portions 98. Each of bendable strips 84 has an engaging hole 102 to receive and engage each corresponding projection 100. The bendable portion 38 with the projections 100 and the engaging holes 102, when bent in the same manner as in FIG. 6, can also be kept in its bent position, as shown in FIG. 11, by passing the projections 100 individually through the engaging holes 102.

Although the interior panels according to the first embodiment of the invention are applied to floor panels, as described above, it is to be understood that the invention may also be applied to ceiling panels or wall panels.

What is claimed is:

1. An interior panel which overlies the surface of a slab defining the inside space of a room to form the interior surface of the room so that a space to permit arrangement of signal transmission cables, power cables, and electric devices is secured between the interior panel and the slab surface, comprising:

a plurality of support members set up on the slab surface;

a panel member supported by the support members and suitably spaced apart from the slab surface;

a cable separator interposed between the panel member and the slab surface, the cable separator having the form of a plate with a stepped portion at the peripheral edge portion thereof supported on the support members so that the stepped portion faces upward, whereby the space between the panel member and the slab surface is divided into a first space defined between the panel member and the cable separator for the installation of the signal transmission cables and a second space defined between the cable separator and the slab surface for the installation of the power cables; and bending means provided to at least one part of the stepped portion of the cable separator, whereby the stepped portion is partially bent to form an opening for connecting the first and second spaces.

2. The interior panel according to claim 1, wherein the cable separator is formed of a transparent electric insulating material.

3. The interior panel according to claim 2, wherein the cable separator is formed of polypropylene.

4. The interior panel according to claim 1, wherein both the panel member and the cable separator are square, and leg portions extend downward from the four corners of the panel member, individually.

5. The interior panel according to claim 4, wherein each the support member includes a pedestal fixed on the slab surface, a bolt portion set up on the pedestal, and a square supporting plate screwed on the bolt portion so as to be located at a predetermined distance from the slab surface, so that each leg portion of the panel member and each corner portion of the cable separator are supported by the supporting plate of the supporting member.

6. The interior panel according to claim 5, wherein the corner portions of the cable separator and the leg portions of the panel member are supported individually by the supporting plates of the support members in an overlapping manner.

7. The interior panel according to claim 6, wherein the supporting plate of each the support member has four engaging holes formed in the peripheral edge portion thereof, the cable separator has lower projections protruding downward from the four corner portions thereof and adapted to be each fitted in one of the engaging holes of each corresponding support member and upper projections protruding upward from the four corner portions of the cable separator, and each the leg portion of the panel member has a blind hole in the bottom surface thereof adapted to receive the upper projection at its corresponding corner portion of the cable separator.

8. The interior panel according to claim 1, wherein the stepped portion of the cable separator has a level surface and a vertical surface.

9. The interior panel according to claim 8, wherein the bending means includes a first to-be-bent portion forming part of the vertical surface of the stepped portion of the cable separator and capable of being outwardly bent, the first to-be-bent portion being defined by a first cut line portion of a predetermined length extending along the inside edge of the stepped portion of the cable separator, a pair of second cut lines on the vertical surface of the stepped portion extending from their corresponding ends of the first cut line portion to the bottom side of the vertical surface, and a first bend line portion on the vertical surface of the stepped portion extending parallel to the inside edge of the stepped portion so as to connect the respective other ends of the second cut line portions on the opposite side to the first cut line portion.

10. The interior panel according to claim 9, wherein bending means further includes a pair of second to-be-bent portions forming part of the level surface of the stepped portion of the cable separator and capable of being upwardly or downwardly bent, each the second to-be-bent portion being defined by a third cut line portion on the level surface of the stepped portion connecting with the center of the first cut line portion and extending in zigzags at right angles to the inside edge of the stepped portion, a pair of second bend line portions on the level surface of the stepped portion connecting with their corresponding ends of the first cut line portion and extending at right angles to the inside edge of the stepped portion, and a pair of third bend line portions connecting with the first cut line portion and extending inside and parallel to the second bend line portions on the level surface of the stepped portion.

11. The interior panel according to claim 10, wherein bending means further includes insertion slits formed in the level surface of the stepped portion and adapted to receive the end portions of a pair of bendable strips formed by triangularly folding back the pair of second to-be-bent portions upward.

12. The interior panel according to claim 10, wherein a pair of raisable lug portions each defined by a cut line portion and a bend line portion are formed in the first to-be-bent portion, the raisable lug portions being adapted to be raised to hold down individually a pair of second bendable strips formed by bending the second to-be-bent portions downward when the first to-be-bent portion is bent straight to the outside.

13. The interior panel according to claim 4, wherein the panel member is further provided with an indentation formed in one side portion thereof so as to connect with the first space and adapted, if necessary, to hold therein a floor outlet, an outlet box, or a cable fitting, and, if unnecessary, to be filled up with a blank piece.

* * * * *